US008586514B2

(12) United States Patent
Kato et al.

(10) Patent No.: US 8,586,514 B2
(45) Date of Patent: Nov. 19, 2013

(54) LUBRICANTS FOR USE IN PROCESSING OF METALLIC MATERIAL AND METHODS FOR PROCESSING THE METALLIC MATERIAL USING THE LUBRICANTS

(75) Inventors: Mami Kato, Toyota (JP); Teruo Fukaya, Nagoya (JP)

(73) Assignee: Toyota Boshoku Kabushiki Kaisha, Aichi-ken (JP)

( * ) Notice: Subject to any disclaimer, the term of this patent is extended or adjusted under 35 U.S.C. 154(b) by 744 days.

(21) Appl. No.: 12/516,808

(22) PCT Filed: Jan. 11, 2008

(86) PCT No.: PCT/JP2008/050658

§ 371 (c)(1),
(2), (4) Date: May 29, 2009

(87) PCT Pub. No.: WO2008/084884

PCT Pub. Date: Jul. 17, 2008

(65) Prior Publication Data

US 2010/0071431 A1 Mar. 25, 2010

(30) Foreign Application Priority Data

Jan. 12, 2007 (JP) ..... 2007-004317

(51) Int. Cl.
*C10M 169/04* (2006.01)

(52) U.S. Cl.
USPC ..... 508/110; 508/390; 508/391

(58) Field of Classification Search
USPC ..... 508/390, 110, 391
See application file for complete search history.

(56) References Cited

U.S. PATENT DOCUMENTS

| | | | | |
|---|---|---|---|---|
| 3,267,037 | A | 8/1966 | Mitacek et al. | |
| 4,446,039 | A * | 5/1984 | Pindar et al. | 508/585 |
| 5,104,558 | A | 4/1992 | Matsuzaki | |
| 5,919,276 | A * | 7/1999 | Jeffrey | 44/370 |
| 2009/0011965 | A1 | 1/2009 | Kato et al. | |

FOREIGN PATENT DOCUMENTS

| | | | |
|---|---|---|---|
| CN | 1186107 | A | 7/1998 |
| DE | 2607614 | A1 | 12/1976 |
| EP | 1394289 | A | 3/2004 |
| JP | 60-019952 | B2 | 5/1985 |
| JP | 62-297390 | | 12/1987 |
| JP | 5-247479 | A | 9/1993 |
| JP | 7-78226 | | 8/1995 |
| JP | 8-269681 | | 9/1996 |
| JP | 10-46176 | | 2/1998 |
| JP | 10-279979 | A | 10/1998 |
| JP | 2960197 | | 7/1999 |
| JP | 2002-105476 | | 4/2002 |
| JP | 2004-323613 | | 11/2004 |
| JP | 2005-41995 | | 2/2005 |
| WO | 2006/095931 | A2 | 9/2006 |

OTHER PUBLICATIONS

U.S. Department of Energy (www.afdc.energy.gov/afdc/pdfs/fueltable.pdf), Properties of Fuel, Oct. 25, 2010.*
English language Abstract of JP 10-279979 A.
English language Abstract of JP 60-019952 B2.
English language Abstract of JP 5-247479 A.
U.S. Appl. No. 12/327,966 to Kato et al., filed Dec. 4, 2008.
Chinese Office Action issues with respect to counterpart Chinese Patent Application No. 2008800014740, mailed May 16, 2012 and English-language translation thereof.
Office Action issued with respect to patent family member Japanese Patent Application No. 2007-004317, mailed Jun. 26, 2012.
Japan Office action that issued with respect to Japanese Patent Application No. 2007-004317, dated Apr. 3, 2012 along with an English translation thereof.

* cited by examiner

*Primary Examiner* — Taiwo Oladapo
(74) *Attorney, Agent, or Firm* — Greenblum & Bernstein, P.L.C.

(57) ABSTRACT

A lubricant for use in processing of a metallic material includes a lubricant base composed of at least one paraffinic hydrocarbon and a modifier oil added to the lubricant base at a rate of 2-20 wt % of total weight of the lubricant. The modifier oil contains (a) a sulfuric extreme pressure agent, (b) a rust inhibitive agent and (c) a calcium ingredient. Content of sulfur is 0.5-20 wt % of total weight of the modifier oil. Content of the rust inhibitive agent is 0.1-15 wt % of total weight of the modifier oil. Further, content of calcium is 0.1-15 wt % of total weight of the modifier oil.

2 Claims, No Drawings

LUBRICANTS FOR USE IN PROCESSING OF METALLIC MATERIAL AND METHODS FOR PROCESSING THE METALLIC MATERIAL USING THE LUBRICANTS

RELATED APPLICATION

This application is a national stage entry of PCT/2008/050658 filed Jan. 11, 2008 which claims priority from Japanese Patent Application No. 2007-004317, filed Jan. 12, 2007, which is incorporated by reference in its entirety.

TECHNICAL FIELD

The present invention relates to lubricants for use in processing (e.g., press working) of a metallic material (which is also referred to as metal processing). More particularly, the present invention relates to lubricants for use in processing of a high tensile strength steel sheet at subzero temperatures. Further, the present invention relates to methods for processing the metallic material using the lubricants.

BACKGROUND ART

In recent years, when a metallic material is processed using a processing tool (a mold), lubricants are generally omitted in order to reduce processing costs. That is, the metallic material is generally processed by a dry processing. However, if the metallic material is processed without using the lubricants (i.e., if the metallic material is processed with the aid of rust inhibitive oils which are previously applied thereto), the metallic material cannot be suitably processed because of lack of lubricity, thereby producing cracking and galling in a formed product. Also, such lack of lubricity may increase friction between the metallic material and the processing tool. Such friction may significantly reduce service life of the forming dies.

In order to solve these problems, there is a need to develop lubricants or rust inhibitors that provide excellent lubricity during the processing of the metallic material. Up to now some special lubricants have been developed. For example, Japanese Laid-open Patent Publication Number 10-279979 teaches a rust inhibitive oil solution for use in the press forming of the metallic material. This oil solution contains a rust inhibitive agent, ultrabasic calcium sulfonate, a sulfuric extreme pressure agent and potassium borate. However, this oil solution contains a boron compound (potassium borate) that is pertinent to Pollutant Release and Transfer Register (PRTR). Therefore, such an oil solution is negative from the viewpoint of environmental preservation.

Post-treatment of the processing of the metallic material may, for example, include the steps of plating or coating the product. When the product is plated or coated as the post-treatment, the metallic material must be processed by the dry processing, because the lubricants remaining on the product may cause a negative effect (e.g., surface irregularity and inferior adhesion) on a plating film or coating film of the product. If the metallic material is processed using the lubricants, the lubricants remaining on the product must be removed or washed out from the product before the product is plated or coated. However, this step may lead to increased costs.

In recent years, from a point of view of environmental concerns and production efficiency, some quick-drying lubricants for use in metal processing have been developed. The known quick-drying lubricants may generally contain a volatile lubricant base that can be naturally evaporated at ordinary temperature and pressure. The quick-drying lubricants thus formulated may omit the washing step, because the nonvolatile lubricant residues are not substantially left on the metallic material after the metallic material is processed.

However, some of the known quick-drying lubricants do not have sufficient lubricity. The insufficient lubricity may cause cracking and galling in the formed product. In addition, the insufficient lubricity cannot sufficiently reduce the friction between the metallic material and the mold. As a result, the service life of the mold cannot be sufficiently extended. In order to increase the lubricity of the quick-drying lubricants, some of the known quick-drying lubricants contain chlorine ingredients. However, the chlorine ingredients contained in the lubricants can be easily decomposed to produce undesirable decomposition products during processing or with time. The decomposition products thus produced may rust the metallic material and the processing tool. Further, the chlorine ingredients may produce harmful or toxic substances when the lubricants are incinerated. Also, the chlorine ingredients may corrode or damage incinerators. In order to solve these problems, there is a need to develop improved or nonchlorine quick-drying (volatile) lubricants that can provide substantially the same lubricity as the nonvolatile lubricants.

Up to now some nonchlorine volatile lubricants for use in metal processing have been developed. For example, Japanese Laid-open Patent Publication Number 60-19952 teaches a nonchlorine volatile lubricative composition (lubricant) for use in metal processing, which composition includes a halogenated hydrocarbon (a lubricant base) having a boiling point of 23-125° C. and a fluorine containing oil having a boiling point of 130-250. However, the halogenated hydrocarbon and the fluorine containing oil is not friendly for the environment.

Further, the quick-drying lubricants can be naturally evaporated within hours or days at ordinary temperature and pressure. Therefore, when the metallic material is processed at ordinary temperature or higher temperatures, the metallic material and the processing tool are not sufficiently lubricated. Similarly, when the metallic material is processed at high speeds, the metallic material and the processing tool are not sufficiently lubricated, because the lubricants can be more rapidly evaporated. In addition, at higher temperatures, viscosity of the lubricants is generally reduced. Such reduction of viscosity may cause lack of lubricity of the lubricants.

In order to solve this problem, the metallic material can be processed at subzero temperatures. In subzero temperatures, the lubricants can be effectively restricted from evaporating. In addition, the lubricants may generally have increased viscosity. As a result, the metallic material and the processing tool can be sufficiently lubricated during the processing.

For example, Japanese Laid-open Patent Publication Number 5-247479 teaches a lubricative composition (lubricant) for use in metal processing at subzero temperatures, which composition includes a praffinic compound (a lubricant base). The lubricant is formulated so as to be used at temperatures of −50° C. to −150° C.

DISCLOSURE OF INVENTION

Accordingly, there is a need to develop improved nonchlorine quick-drying (volatile) lubricants that can be used at subzero temperatures.

In one embodiment of the present invention, a lubricant is taught for use in processing of a metallic material. The lubricant includes a lubricant base composed of at least one paraffinic hydrocarbon and a modifier oil added to the lubricant base at a rate of 2-20 wt % of total weight of the lubricant. The modifier oil contains (a) a sulfuric extreme pressure agent, (b)

a rust inhibitive agent and (c) a calcium ingredient. Content of sulfur is 0.5-20 wt % of total weight of the modifier oil. Content of the rust inhibitive agent is 0.1-15 wt % of total weight of the modifier oil. Further, content of calcium is 0.1-15 wt % of total weight of the modifier oil.

Further, the present lubricant is intended to process a high tensile strength steel sheet as the metallic material. The high tensile strength steel sheet generally corresponds to a steel sheet having tensile strength of 340 $N/mm^2$ or more. Conversely, a steel sheet having tensile strength less than 340 $N/mm^2$ is referred to as a mild steel sheet.

The high tensile strength steel sheet may also be referred to as "high strength steel sheet" or "high tensile material." However, Japanese Industrial Standard generally uses the term "high tensile strength steel sheet" in, for example, JIS G 3134 (which is directed to "processible hot rolled high tensile strength steel sheets and bands for mobile application") and JIS G 3135 (which is directed to "processible cold rolled high tensile strength steel sheets and bands for mobile application"). Therefore, in this description, "high tensile strength steel sheet" used in JIS G 3134 and JIS G 3135 will be used hereinafter.

The present lubricant may have improved performance superior to the conventional lubricant. That is, the lubricant may have improved lubricity when the metallic material is processed or press formed. Therefore, the lubricant may effectively prevent formation of cracking and galling in the processed metallic material, thereby increasing processing accuracy of the metallic material.

Further, the present lubricant may have quick-drying property and good odor property. In addition, when the press formed metallic material is washed as pre-treatment of plating, the lubricant can be easily removed therefrom. Therefore, the formed metallic material can be uniformly plated or coated without producing surface irregularity or inferior adhesion on a plating film or coating film.

Also, the lubricant may have excellent rust inhibiting performance due to the modifier oil contained therein. Therefore, the formed metallic material can be effectively prevented from rusting.

Further, the present lubricant may preferably be formulated so as to have freezing point of not more than −40° C. When the metallic material applied with the lubricant thus formulated is processed at a temperature of −5 to −35° C., the lubricant may have further increased lubricity. This is because the lubricant may have increased viscosity at the temperature of −5 to −35° C. Therefore, the processing speed of the metallic material can be increased at subzero temperatures.

Further, the present lubricant does not contain chlorine-based additives. Therefore, the lubricant is friendly for the environment.

Other objects, features and advantages of the present invention will be readily understood after reading the following detailed description together with the accompanying drawings and the claims.

BEST MODE FOR CARRYING OUT THE INVENTION

In the following, a detailed representative embodiment of the present invention will be described.

A lubricant of the present invention is intended to be used in processing of a metallic material using a processing tool (punches and dies). Examples of the processing may include press working, e.g., press forming, blanking, fine blanking, piercing, bending, burring, drawing, trimming and crimping. As will be appreciated, the metallic material can be processed or formed to a desired shaped processed metallic material or product (e.g., car parts) by the processing.

The lubricant may include a lubricant base (a main ingredient) composed of a paraffinic (saturated chain) hydrocarbon and a modifier oil (a supplemental ingredient) added to the lubricant base. In this embodiment, the modifier oil may preferably composed of a modifier oil base that contains a sulfuric extreme pressure agent (Ingredient A), a rust inhibitive agent (Ingredient B) and a calcium ingredient (Ingredient C) as essential additives.

First, the lubricant base of the lubricant will be described. The paraffinic hydrocarbon in this embodiment may include liner hydrocarbons (normal paraffin), branched chain hydrocarbons (isoparaffin) and cyclic hydrocarbons (cycloparaffin). The paraffinic hydrocarbon may preferably have a carbon number of 8-16. That is, the paraffinic hydrocarbon may preferably have the formula, $C_nH_{2n+2}$, wherein n is an integer from 8-16. In particular, the paraffinic hydrocarbon may be at least one of the compounds selected from the group of octane ($C_8$), nonane ($C_9$), decane ($C_{10}$), undecane ($C_{11}$), dodecane ($C_{12}$), tridecane ($C_{13}$), tetradecane ($C_{14}$), pentadecane ($C_{15}$), hexadecane ($C_{16}$) and isomers thereof. Further, if a special paraffinic hydrocarbon is solely used, it is preferable to select a paraffinic hydrocarbon having a carbon number of 8-13. As will be recognized, the paraffinic hydrocarbon having a carbon number of 8-16 may be liquid at ordinary temperature.

Generally, the paraffinic hydrocarbon may increase in boiling point with the carbon number. The paraffinic hydrocarbon having a carbon number of 16 or more may have an excessively high boiling point (i.e., an excessively slow evaporation rate). Therefore, such a higher paraffinic hydrocarbon is not preferable for the lubricant base or lubricant ingredient. In addition, the paraffinic hydrocarbon having a carbon number of 16 or more may generally be solid at ordinary temperature. Therefore, the higher paraffinic hydrocarbon having a carbon number of 16 or more is not preferable for the lubricant ingredient. Further, it is preferable that the paraffinic hydrocarbon having a carbon number near 16 is used as a mixture with another paraffinic hydrocarbons. Conversely, the paraffinic hydrocarbon having a carbon number of 5-7 may have a sufficiently low boiling point (i.e., an allowable evaporation rate). Therefore, such a lower paraffinic hydrocarbon can be used as the lubricant ingredient. However, the paraffinic hydrocarbon having a carbon number of 5-7 is not generally preferable for the lubricant ingredient because it may generally produce a bad smell. Further, the paraffinic hydrocarbon having a carbon number of 1-4 may generally be gas at ordinary temperature. Therefore, the paraffinic hydrocarbon having a carbon number 1-4 cannot substantially be used as the lubricant ingredient. Further, the paraffinic hydrocarbon having a carbon number of 8-13 may have an extremely high evaporation speed.

The paraffinic hydrocarbon may preferably have a boiling point of 210° C. or less. The lubricant containing such a low boiling point paraffinic hydrocarbon can naturally and rapidly evaporate from the metallic material within several hours to one day at ordinary temperature and pressure. Therefore, the lubricant can be evaporated within 24 hours, which time period corresponds to a maximum permitted time period in which the processed metallic material must be transferred to a next step (e.g., a plating or coating step) in a manufacturing line. As a result, it is not necessary to stop the manufacturing line in order to dry the processed metallic material. Further, it is preferable that the lubricant has a reasonable evaporation speed. The paraffinic hydrocarbon having a carbon number of 8 has a boiling point of 70° C.

Next, the modifier oil of the lubricant will be described. As will be recognized, the modifier oil is added to the lubricant base in small amounts in order to provide the lubricant with additional functions. The modifier oil base may be at least one member that is selected from the group consisting of mineral oils, synthetic oils and fatty oils. These oils may preferably include all mineral oils, synthetic oils and fatty oils that are known per se for use in a lubricant for processing a metallic material. In other words, these oils are not limited to special oils.

Examples of the mineral oils are many kinds of mineral oils that can be produced in a general petroleum refinery process. Such a petroleum refinery process may include the steps of distilling a crude petroleum under normal and reduced pressures so as to obtain a distillate, and further treating the obtained distillate via at least one of solvent deasphalting, solvent extraction, hydrocracking, solvent dewaxing, catalytic dewaxing, hydrorefining, sulfuric acid scrubbing and white earth treatment.

Examples of the synthetic oils are poly-α-olefins, α-olefin copolymers, poly butenes, alkyl benzenes, polyoxyalkyleneglycols, polyoxyalkyleneglycol ethers, silicone oils and other such compounds.

Examples of the fatty oils are a beef fat, a lard, a soy been oil, a canola oil, a rice bran oil, a coconut oil, a palm oil, a palm kernel oil and hydrogenated products thereof.

Next, the three essential additives of the modifier oil base, i.e., the sulfuric extreme pressure agent (Ingredient A), the rust inhibitive agent (Ingredient B) and the calcium ingredient (Ingredient C) will be described.

In this embodiment, the sulfuric extreme pressure agent (Ingredient A) may preferably include various types of sulfuric compounds that can provide extreme pressure property. In other words, the sulfuric extreme pressure agent is not limited to special sulfuric compounds. Examples of the sulfuric extreme pressure agent are sulfurized fats, sulfurized fatty acids, sulfuric esters, sulfurized olefins, polysulfides, thiocarbamates and sulfurized mineral oils. Further, the sulfurized fats may preferably be made by reacting sulfur with various types of fats (e.g., a lard, whale oils, vegetable oils and fish oils). The sulfurized fats may include a sulfurized lard, a sulfurized canola oil, a sulfurized caster oil and a sulfurized soy been oil. In addition, the sulfurized fatty acids may include a sulfide of oleic acid. Also, the sulfuric esters may include a sulfide of methyl oleate and a sulfide of octyl rice bran fatty acid.

The sulfurized olefins may preferably be produced by reacting $C_2$-$C_{15}$ olefins or their multimers (e.g., dimers, trimers or tetramers) with a sulfurize agent such as sulfur and sulfur chloride.

Examples of the polysulfides are dibenzylpolysulfides, di-tert-nonylpolysulfides, didodecylpolysulfides, di-tert-butylpolysulfides, dioctylpolysulfides, diphenylpolysulfides and dicyclohexylpolysulfides.

Examples of the thiocarbamates are zinc thiocarbamates, dilaurylthiodipropionates and distearylthiodipropionates.

The sulfurized mineral oils may preferably be produced by dissolving elementary sulfur into mineral oils. The mineral oils for use in preparation of the sulfurized mineral oils may be, for example, but are not limited to, the same mineral oils as the mineral oils for use in the modifier oil base.

Moreover, the sulfuric extreme pressure agent (Ingredient A) may include sulfur atom containing organozinc compounds. Examples of the organozinc compounds are zinc dialkyldithiophosphate (which will be referred to ZnDTP hereinafter) and zinc dialkyldithiocarbamic acid (which will be referred to ZnDTC hereinafter). Alkyl groups contained in ZnDTP and ZnDTC may be identical with or different from each other. That is, in ZnDTP, two alkyl groups bonding to a phosphorus atom via an oxygen atom may be identical with or different from each other. Similarly, in ZnDTC, two alkyl groups bonding to a nitrogen atom may be identical with or different from each other. The alkyl groups contained in ZnDTP and ZnDTC may preferably be alkyl groups having a carbon number of three or more. Further, these alkyl groups can be replaced by aryl groups.

In the present invention, the above-described compounds for the sulfuric extreme pressure agent can be used in either a pure form or in a combined form. Further, the sulfuric extreme pressure agent may preferably be added to the modifier oil base such that sulfur content in the modifier oil is not less than 0.5 wt % of total weight of the modifier oil and not greater than 20 wt % of total weight of the modifier oil, more preferably not less than 2 wt % and not greater than 15 wt %. If the sulfur content in the modifier oil is less than 0.5 wt % of total weight of the modifier oil, the formulated lubricant may have insufficient lubricity. On the contrary, if the sulfur content in the modifier oil is greater than 20 wt % of total weight of the modifier oil, the formulated lubricant may have sufficient or superior lubricity. However, the lubricant may instead have inferior rust inhibiting performance after the metallic material having the lubricant is welded by a MAG welding method.

The rust inhibitive agent (Ingredient B) is not limited to special compounds. Examples of the rust inhibitive agent are sulfonates or sulfonic acid compounds of calcium (Ca), barium (Ba) and sodium (Na), ester compounds of oxidized waxes, oxidized wax compounds (e.g., Ca-, Ba- and Na-salts of the oxidized waxes), polyalcohol esters (e.g., solbitanmonooleate), lanolin, and metallic soap of lanolin. However, the compounds containing Ca or Ba are more preferred. In this invention, the above-described compounds for the rust inhibitive agent can be used in either a pure form or in a combined form. Generally, the rust inhibitive agent may be mixed with mineral oils, synthetic oils and various types of esters, so as to be easily dissolved into the modifier oil base.

In the present invention, content of the rust inhibitive agent in the modifier oil is not less than 0.1 wt % of total weight of the modifier oil and not greater than 15 wt % of total weight of the modifier oil, more preferably not less than 1 wt % and not greater than 10 wt %. If the content of the rust inhibitive agent in the formulated modifier oil is less than 0.1 wt % of total weight of the modifier oil, the formulated lubricant may have insufficient rust inhibiting performance after the metallic material having the lubricant is welded by the MAG welding method. On the contrary, even if the content of the rust inhibitive agent in the modifier oil is increased to be greater than 15 wt % of total weight of the modifier oil, the lubricant may only have limited effects.

The calcium ingredient (Ingredient C) may include, but are not limited to, calcium sulfonates, calcium salicylates and calcium phenates. However, the calcium sulfonates are preferred in terms of kinetic viscosity and price. More preferred are basic calcium sulfonates. Further more preferred are highly-basic calcium sulfonates having base value of 300 mgKOH/g or more.

In this invention, the above-described compounds for the calcium ingredient can be used in either a pure form or in a combined form. Further, calcium content in the modifier oil is not less than 0.1 wt % of total weight of the modifier oil and not greater than 15 wt % of total weight of the modifier oil, more preferably not less than 0.2 wt % and not greater than 10 wt %. If the calcium content in the modifier oil is less than 0.1 wt % of total weight of the modifier oil, the formulated lubricant may have insufficient lubricity. On the contrary, if the calcium content in the modifier oil is greater than 15 wt % of total weight of the modifier oil, the lubricant may only have limited effects.

As described above, the modifier oil may preferably be formulated from the lubricant oil base by adding Ingredient A, Ingredient B and Ingredient C thereto. The modifier oil thus formulated may be added to the lubricant base at a rate of 2 to 20 wt % of total weight of the lubricant. If the modifier oil content in the lubricant is less than 2 wt % of total weight of the lubricant, the lubricant may have an insufficient rust inhibitive performance. On the contrary, if the modifier oil content in the lubricant is greater than 20 wt % of total weight of the lubricant, the lubricant may produce considerable lubricant residues on the metallic material after the metallic material is processed. Such lubricant residues may cause a negative effect (e.g., surface irregularity and inferior adhesion) on a plating film or coating film of the product after the processed metallic material is plated or coated.

Further, various types of known additional agents can be added to the lubricant without obscuring the object of the invention in order to increase or stabilize basic properties of the lubricant, if necessary. The known agents may include an antioxidizing agent, a corrosion prevention agent, a coloring agent, an antifoaming agent and a fragrant material. Examples of the antioxidizing agent are amine series compounds and phenolic compounds. Examples of the corrosion prevention agent are benzotriazols, tolyltriazols and mercaptobenzothiazoles. Further, the coloring agent may be various types of dyestuffs and pigments.

The lubricant may preferably be formulated so as to have freezing point of not more than −40° C. The lubricant having such a low freezing point can be prevented from freezing when the metallic material is processed at subzero temperatures, e.g., −5 to −35° C. That is, in such a range of temperatures, the lubricant can be available in a liquid form. In addition, the lubricant can be effectively prevented from evaporating. Therefore, according to the present lubricant, the metallic material can be reliably processed with superior dimensional accuracy.

The lubricant may preferably be formulated so as to have kinetic viscosity of not greater than 12.5 $mm^2/s$ at −20° C., preferably not greater than 10.0 $mm^2/s$, more preferably not greater than 7.5 $mm^2/s$. The lubricant having such kinetic viscosity may provide excellent lubricity when the metallic material is processed (e.g., press formed). At the same time, such a lubricant may have a substantial fluidity at subzero temperatures. If the lubricant has kinetic viscosity of greater than 12.5 $mm^2/s$ at −20° C., the lubricant may have reduced lubricity. Further, it is preferred that the lubricant may have kinetic viscosity of at least 2.5 in order to ensure required lubricity of the lubricant. As will be appreciated, as the temperature of the lubricant is lowered, the lubricant may have reduced kinetic viscosity so as to have increased lubricity.

The lubricant may preferably be formulated so as to have a flash point of 40° C. or more and an ignition point of 240° C. or more. The lubricant having a flash point not less than 40° C. can be handled in safety at ordinary temperature. Generally, the lubricant having a flash point less than 40° C. is highly flashable at ordinary temperature. Therefore, such a lubricant cannot be safely handled, in particular, in summertime or in tropical or subtropical regions. Further, the lubricant having an ignition point not less than 240° C. can be handled in safety, because such a high ignition point lubricant may have a low risk of ignition by heat or sparks that is produced during processing of the metallic material.

The lubricant may be applied between the processing tool and the metallic material in order to lubricate therebetween. Generally, the lubricant may be applied to the metallic material by means of, for example, but are not limited to, a roller and a sprayer. The lubricant thus applied may effectively prevent formation of cracking and galling in the processed metallic material, thereby increasing processing accuracy of the metallic material. In addition, the lubricant that is applied between the processing tool and the metallic material may effectively protect the processing tool from rusting and damaging, thereby providing a prolonged working life of the processing tool.

When the metallic material to be processed is a high tensile strength steel sheet, the metallic material may preferably be processed at subzero temperatures in order to increase processability thereof. Preferably, the metallic material is processed at temperatures of −5 to −35° C., preferably −10 to −30° C., and more preferably −15 to −25° C., because the lubricant is formulated so as to have freezing point of not more than −40° C. In such a range of temperatures, the lubricant can be available in a liquid form. In addition, the lubricant can be effectively prevented from evaporating. Therefore, the metallic material can be reliably processed at desired processing speeds. As will be appreciated, if the metallic material is processed at temperatures in excess −5° C., the lubricant may rapidly evaporate from the metallic material. Conversely, if the metallic material is processed at temperatures below 35° C., the lubricant can be crystallized on the metallic material.

Next, the metallic material used in the present embodiment will be described. Examples of the metallic material are rolled steel sheets of ferrous materials (e.g., stainless steel, alloy steel, carbon steel) and nonferrous materials (e.g., aluminum alloy and copper) that have been broadly used in many fields for manufacturing cars, architectural materials, white goods, electronic devices or other such articles. In particular, examples of the metallic material are a cold rolled steel sheet, a hot rolled steel sheet, a rust-resistant rolled steel sheet (e.g., a galvanized steel sheet) and a high tensile strength steel sheet. Further, the lubricant of the present invention may have beneficial effects in the processing of the high tensile strength steel sheet.

Further, post-treatment of the processing may generally be performed. The post-treatment of the processing may, for example, include the steps of (1) degreasing and washing the formed product in order to remove the lubricant, (2) applying the washed product with rust inhibitive oils in order to protect the product from rusting, (3) plating or coating the product, (4) treating the product by heat in order to strengthen the product, and (5) welding the product to another metal component.

For example, when the processed metallic material is plated or coated as the post-treatment, the metallic material is generally be degreased or washed. However, the present lubricant can be naturally evaporated at ordinary temperature and pressure, so that nonvolatile lubricant residues are not substantially left on the metallic material. Therefore, the degreasing or washing step can be substantially omitted or simplified.

Further, in order to weld the high tensile strength steel sheet, a metal active gas (MAG) welding method is often used. This welding method is one of typical steel welding methods. The MAG welding method is the most widely used arc welding method for welding steel. Generally, the MAG welding method has advantages of increased welding speed, high welding efficiency and easy handling. Also, this welding method may provide high quality welding portions. Further, this welding method can be applied to metallic materials having a wide variety of thickness without changing a welding wire.

In the MAG welding method, it is possible to use a pure gas of carbon dioxide and a mixed gas of argon and carbon dioxide as a shielding gas. However, the pure gas of carbon dioxide is a highly oxidized gas. Such an oxidized gas can oxidize and deteriorate a welding product (i.e., a welding composite constituted of a welding wire metal and a matrix steel) produced in the welding portions. The deteriorated welding product may reduce bonding strength of the welding portions. Therefore, when the MAG welding method is used for welding the high tensile strength steel sheet, the mixed gas of argon and carbon dioxide may generally be used as the shielding gas in order to prevent the welding portions from excessively deteriorating. Preferably, the mixing ratio of argon to carbon dioxide is approximately 80:20.

In this embodiment, if the high tensile strength steel sheet is used as the metallic material, the acceptable thickness thereof may be not greater than 3.0 mm, more preferably not greater than 2.0 mm, and most preferably not greater than 1.6 mm. Generally, it is preferable that the metallic material may have a thickness of at least 0.1 mm.

The examples of the lubricant of the present invention will now be described. Further, the following examples are illustrative and should not be construed as limitations of the invention.

In a first test, seven sample lubricants (Lubricant Samples 1-7) were prepared by utilizing the paraffinic hydrocarbons (the lubricant base) having various carbon numbers. Compositions of the seven types of sample lubricants are shown in Table 1. As will be easily understood, each of the sample lubricants is composed of only the lubricant base.

TABLE 1

| | | Carbon Number | Containing Rate of Lubricant Base (wt %) | Containing Rate of Additives (wt %) | Types |
|---|---|---|---|---|---|
| Lubricant Samples | 1 | 8-10 | 100 | 0 | Mixed Oil |
| | 2 | 10-13 | 100 | 0 | Mixed Oil |
| | 3 | 13-16 | 100 | 0 | Mixed Oil |
| | 4 | 8-16 | 100 | 0 | Mixed Oil (Kerosene) |
| | 5 | 10-26 | 100 | 0 | Mixed Oil (Light Oil) |
| | 6 | 4-12 | 100 | 0 | Mixed Oil (Gasoline) |
| | 7 | 14-30 | 100 | 0 | Mixed Oil |

With regard to Lubricant Samples 1-7, lubrication performance was evaluated. In order to evaluate the lubrication performance, metallic materials (work pieces) having the lubricants were respectively processed or press worked (sheared or punched), so as to produce formed products (test pieces).

Preparation of the formed products was carried out under following conditions.

Processing Machine

AIDA pressing machine having a punch and a die (Aida Engineering)

Processing speed: 60 spm

Material of the punch: SKD11

Material of the die: SKD11

Work Pieces

SECC (JIS G3313; Steel Plates for General Purposes)

Width: 150 mm

Thickness: 0.3 mm

Application of the Lubricants

The Lubricant Samples 1-7 were uniformly fed to the surfaces of the work pieces by a resin roll coater.

Processing (1)

The work pieces having the lubricants were respectively subjected to punching by the punch, thereby producing the formed products (test pieces) that have 3000 punched holes of 2.5 mm, 6.0 mm, 22 mm and 100 mm in diameter.

Processing (2)

The work pieces having the lubricants were respectively subjected to drawing by the punch, thereby producing the formed products (test pieces) that have 3000 draw portions of 2.5 mm in diameter.

After the processing (punching and drawing) of each of the work pieces was completed, the punch was visually observed for the surface appearance thereof, so as to determine occurrence of defects, including wear and damage. The appearance of the punch was evaluated based on the following evaluation standards:

A: Superior (No defects)

B: Fine or Good (Substantially no defects)

C: Poor (Minor defects)

D: Inferior (Significant defects)

In addition, each of the formed products thus formed was visually observed for the processed surface appearance of the punched holes and the draw portions, so as to determine occurrence of defects, including damage and burr. The processed surface appearance of the punched holes and the draw portions was evaluated based on the following evaluation standards:

A: Superior (No defects)

B: Fine or Good (Substantially no defects)

C: Poor (Minor defects)

D: Inferior (Significant defects)

Results are shown in Table 2.

TABLE 2

| | | Lubricant Samples | | | | | | |
|---|---|---|---|---|---|---|---|---|
| | | 1 | 2 | 3 | 4 | 5 | 6 | 7 |
| Processing (1) | Appearance of Punch | A | A | A | A | A | B | A |
| | Appearance of Processed Surface | A | A | A | A | A | B | A |
| Processing (2) | Appearance of Punch | A | A | A | A | A | B | A |
| | Appearance of Processed Surface | A | A | A | A | A | B | A |

As shown in Table 2, except for Lubricant Sample 6, the punch may have superior surface appearance in both of processing (1) and (2). This means that the lubricants of Lubricant Samples 1-5 and 7 may effectively prevent the punch from wearing during processing (punching and drawing). Also, except for Lubricant Sample 6, the punched holes and the draw portions of the formed products may have superior surface appearance. This means that the lubricants of Lubricant Samples 1-5 and 7 may form the punched holes and the draw portions free from damage and burr. These results demonstrate that the lubricants containing only the paraffinic hydrocarbons having carbon numbers of 8 or more may have excellent lubricity during processing. In other words, the lubricants containing the paraffinic hydrocarbons having carbon numbers less than 8 may have reduced lubricity.

In a second test, seven sample lubricants (Lubricant Samples 1-7) were prepared in the same manner as the first test. Compositions of Lubricant Samples 1-7 are shown in Table 1.

With regard to Lubricant Samples 1-7, volatility or drying property was evaluated. In order to evaluate the volatility, drying time was measured with regard to each of metallic materials (work pieces) having the lubricants.

The second test was carried out under following conditions.

Work Pieces
SPCC (JIS G3141)
Length: 80 mm
Width: 60 mm
Thickness: 1.0 mm
Application of the Lubricants
Lubricant Samples 1-7 were uniformly applied to the surfaces of the work pieces.
Amounts of the Lubricants
0.5 g for each of the work pieces With regard to each of the work pieces, the drying time was measured. Measurement was performed in a condition that the work pieces were horizontally positioned in air.

Results are shown in Table 3.

TABLE 3

| | Lubricant Samples | | | | | | |
|---|---|---|---|---|---|---|---|
| | 1 | 2 | 3 | 4 | 5 | 6 | 7 |
| Drying Time (Hour) | 2 | 2 | 30 | 30 | 48 or more | 1 | 48 or more |

As shown in Table 3, Lubricant Samples 5 and 7 may have considerably long drying time (more than 48 hours). To the contrary, Lubricant Samples 1, 2 and 6 may have extremely short drying time (within 2 hours). This means that Lubricant Samples 1, 2 and 6 may have extremely high volatility. These results demonstrate that the lubricants containing only the paraffinic hydrocarbons having carbon numbers not greater than 13 can be rapidly evaporated from the work pieces. Further, Lubricant Samples 3 and 4 may have drying time of 30 hours. This means that the lubricants containing only the paraffinic hydrocarbons having carbon numbers not greater than 16 may have acceptable volatility.

In a third test, seven sample lubricants (Lubricant Samples 1-7) were prepared in the same manner as the first test. Compositions of Lubricant Samples 1-7 are shown in Table 1.

With regard to Lubricant Samples 1-7, odors emitted therefrom were evaluated. The odors were sensuously evaluated with regard to the lubricants.

The third test was carried out under following conditions.

Test Samples of the Lubricants
Lubricant Samples 1-7 were respectively dispensed into glass beakers of 500 ml.
Amounts of the Dispensed Lubricants
100 ml for each of the beakers Five or more persons independently smelled the test samples of the lubricants in the beakers, thereby evaluate the odors of the lubricants. The odor of each of the lubricants was evaluated based on the following evaluation standards:

A: Superior (Good smell)
B: Fine or Good (Sharp smell but not bad smell)
C: Poor (Sharp bad smell)

Results are shown in Table 4.

TABLE 4

| | Lubricant Samples | | | | | | |
|---|---|---|---|---|---|---|---|
| | 1 | 2 | 3 | 4 | 5 | 6 | 7 |
| Evaluation of Odors | A | A | A | B-C | B-C | C | A |

As shown in Table 4, Lubricant Samples 1-3 may have good smell. However, Lubricant Samples 4-5 do not have agreeable smell. These results demonstrate that the lubricants containing only the paraffinic hydrocarbons having carbon numbers of 8-16 may generally have good smell. In other words, some of the lubricants containing the paraffinic hydrocarbons having carbon numbers less than 8 or greater than 16 may generally have bad smell.

From the results of the first to third tests, the lubricants containing the paraffinic hydrocarbons having carbon numbers of 8-16 at a rate of 100 wt % of total weight thereof may have excellent lubricity, good workability, quick-drying property and good odor property.

Next, in a fourth test, three example modifier oils (Modifier Oil Examples 1-3) were prepared by utilizing the following additives. Compositions of the three types of example modifier oils (Modifier Oil Examples 1-3) are shown in Table 5a.

(a) The sulfuric extreme pressure agent (Ingredient A)
a1: polysulfides (30 wt % sulfur content)
a2: sulfurized fats (15 wt % sulfur content)
a3: ZnDTP (16 wt % sulfur content)
(b) The rust inhibitive agent (Ingredient B)
b1: barium sulfonates
b2: oxidized wax compounds
b3: calcium sulfonates
b4: metallic soap of lanolin
b5: sulfonic acid compounds
(c) The calcium ingredient (Ingredient C)
c1: highly-basic calcium sulfonates (15 wt % calcium content)
(d) Other additives (Ingredient D)
d1: chlorinated paraffins (50 wt % chlorine content)

TABLE 5a

| | Modifier Oil Examples | | |
|---|---|---|---|
| | 1 | 2 | 3 |
| Modifier Oil Base | 53.5 | 52.2 | 48.9 |
| a1 | 5 | 5 | 5 |
| a2 | 25 | 25 | 25 |
| a3 | 10 | 10 | 10 |
| b1 | 0.4 | 1.1 | 0.7 |
| b2 | 0.6 | 1.2 | 1.1 |
| b3 | 0.4 | 0.4 | 1.4 |
| b4 | 0.1 | 0.1 | 1.4 |
| b5 | | | 1.5 |
| c1 | 5 | 5 | 5 |
| d1 | | | |
| Sulfur Content (%) | 6.8 | 6.8 | 6.8 |
| Rust Inhibitive Agent Content (%) | 1.5 | 2.8 | 6.1 |
| Calcium Content (%) | 0.75 | 0.75 | 0.75 |

Further, three control lubricants (Lubricant Controls 1-3) were prepared by utilizing the above-described additives and a control lubricant base. The control lubricant base had substantially the same composition as the modifier oil base.

These three control lubricants (Lubricant Controls 1-3) thus prepared substantially corresponded to commercially available typical lubricants for use in press forming. Also, three additional control lubricants (Lubricant Controls 4-6) were provided. These three control lubricants were two commercially available lubricative rust inhibitive oils for steel (Lubricant Controls 4 and 5) and a commercially available rust inhibitive oil for steel (Lubricant Control 6). Compositions of these six control lubricants (Lubricant Controls 1-6) are shown in Table 5b.

TABLE 5b

| | Lubricant Controls | | | | | |
|---|---|---|---|---|---|---|
| | 1 | 2 | 3 | 4 | 5 | 6 |
| Control Lubricant Base | 45 | 13 | 40 | * | ** | *** |
| a1 | | 5 | | | | |
| a2 | | 20 | 40 | | | |
| a3 | | 12 | 20 | | | |
| b1 | 5 | | | | | |
| b2 | | | | | | |
| b3 | | | | | | |
| b4 | | | | | | |
| b5 | | | | | | |
| c1 | | 50 | | | | |
| d1 | 50 | | | | | |
| Sulfur Content (%) | — | 7.2 | 9.2 | | | |
| Rust Inhibitive Agent Content (%) | 5 | — | — | | | |
| Calcium Content (%) | — | 7.5 | — | | | |

* Commertially available lubricative rust inhibitive oil A for steel
** Commertially available lubricative rust inhibitive oil B for steel
*** Commertially available rust inhibitive oil for steel In Table 5a, the content of each ingredient was expressed as a weight part. The sulfur content (%) was expressed as a weight percent of sulfur atom contained in Ingredient A to the total weight of each modifier oil. Similarly, the calcium content (%) was expressed as a weight percent of calcium atom contained in Ingredient C to the total weight of each modifier oil. Further, the rust inhibitive agent content (%) was expressed as a weight percent of Ingredient B to the total weight of each modifier oil.

In Table 5b, the content of each ingredient was expressed as a weight part. The sulfur content (%) was expressed as a weight percent of sulfur atom contained in Ingredient A to the total weight of each lubricant. Similarly, the calcium content (%) was expressed as a weight percent of calcium atom contained in Ingredient C to the total weight of each lubricant. Further, the rust inhibitive agent content (%) was expressed as a weight percent of Ingredient B to the total weight of each lubricant.

With regard to the example modifier oils of Modifier Oil Examples 1-3 and the control lubricants of Lubricant Controls 1-6, a lubrication performance evaluation test was performed. In order to perform the lubrication performance evaluation test, the work pieces having the example modifier oils and the control lubricants were respectively processed, so as to produce formed articles (test pieces).

Preparation of the formed articles was carried out under following conditions.

Processing Machine 500 ton progressive pressing machine (FUKUI) having a punch and dies Production speed: 45 spm Material of the punch: SKD11

Material of the dies: SKD11

Work Pieces

1. High tensile strength steel sheets having tensile strength of 440 N/mm$^2$

Thickness: 1.0 mm

2. High tensile strength steel sheets having tensile strength of 590 N/mm$^2$

Thickness: 1.8 mm

3. High tensile strength steel sheets having tensile strength of 780 N/mm$^2$

Thickness: 1.2 mm

4. High tensile strength steel sheets having tensile strength of 980 N/mm$^2$

Thickness: 1.0 mm

Application of the Lubricants

Modifier Oil Examples 1-3 and Lubricant Controls 1-6 were uniformly fed to the surfaces of the work pieces by a resin roll coater.

Processing

The work pieces having the lubricants were respectively subjected to sixteen types of processing (e.g., punching, bending, drilling, burring and tapping), thereby producing the formed articles (test pieces) that can be used as parts of a vehicle reclining seat. These processing were carried out simultaneously or successively.

The formed articles thus formed were measured in order to determine dimensional accuracy thereof. From the measured value, the dimensional accuracy of the articles were evaluated based on the following reference levels:

Superior: Meeting dimensional standards

Inferior: Not meeting dimensional standards

In addition, the punch and the dies were visually observed for the surface appearance thereof, so as to determine occurrence of wear. From the appearance, the punch and the dies were evaluated based on the following reference levels:

Superior: No wear

Inferior: Wear

Results are shown in Table 6.

TABLE 6

| | Dimensional Accuracy of Formed Articles | Appearance of Punch and Dies |
|---|---|---|
| Modifier Oil Example 1 | Superior | Superior |
| Modifier Oil Example 2 | Superior | Superior |
| Modifier Oil Example 3 | Superior | Superior |
| Lubricant Control 1 | Superior | Superior |
| Lubricant Control 2 | Superior | Superior |
| Lubricant Control 3 | Superior | Superior |
| Lubricant Control 4 | Inferior | Inferior |
| Lubricant Control 5 | Inferior | Inferior |
| Lubricant Control 6 | Inferior | Inferior |

Table 6 demonstrates that according to the example modifier oils of Modifier Oil Examples 1-3 and the control lubricants of Lubricant Controls 1-3, the work pieces can be reliably processed, so that the formed articles can be formed with superior dimensional accuracy. That is, the example modifier oils of Modifier Oil Examples 1-3 and the lubricants of Lubricant Controls 1-3 may produce the formed articles having a smooth cut surface (shear surface) free from burrs and shear drops and having predetermined dimensions. In addition, it is demonstrated that the example modifier oils of Modifier Oil Examples 1-3 and the lubricants of Lubricant Controls 1-3 may effectively prevent the punch and the dies (i.e., processing tool) from wearing during processing. That is, the example modifier oils of Modifier Oil Examples 1-3 and the lubricants of Lubricant Controls 1-3 may effectively prevent the punch and the dies from galling, seizing and damaging during processing. These results mean that each of the example modifier oils of Modifier Oil Examples 1-3 and the lubricants of Lubricant Controls 1-3 may have superior lubrication performance.

To the contrary, Table 6 demonstrates that according to the rust inhibitive oils of Lubricant Controls 4-6, the work pieces cannot be reliably processed. Therefore, the formed articles cannot be formed with allowable dimensional accuracy. That is, the rust inhibitive oils of Lubricant Controls 4-6 may produce the formed articles having an undesirable rough cut surface (shear surface). These results mean that each of the rust inhibitive oils of Lubricant Controls 4-6 may have inferior lubrication performance.

Next, in a fifth test, three example modifier oils (Modifier Oil Examples 1-3) and six control lubricants (Lubricant Controls 1-6) were prepared in the same manner as the fourth test. Compositions of Modifier Oil Examples 1-3 and the lubricants of Lubricant Controls 1-6 are shown in Tables 5a and 5b.

With regard to the example modifier oils of Modifier Oil Examples 1-3 and the control lubricants of Lubricant Controls 1-6, a rust inhibition performance evaluation test was performed. In order to perform the rust inhibition performance evaluation test, the work pieces coated with the example modifier oils and the control lubricants were welded utilizing the MAG welding method, so as to produce welded articles (test pieces).

The MAG welding was performed under following conditions.

Shield Gas

Mixed gas of argon and carbon dioxide (argon to carbon dioxide=80:20)

Wire Diameter 1.0 mm and 1.2 mm

Current, Voltage and Velocity

145 A, 16V and 60 cm/min

Torch Angle, Welding Length and Welding Width

60°, 40 mm and 10 mm

Work Pieces

1. SPCC steel sheets

Thickness: 1.2 mm

2. High tensile strength steel sheets having tensile strength of 590 N/mm$^2$

Thickness: 1.8 mm

The welded articles thus formed were stored in a test chamber with constant temperature and humidity (a temperature of 50° C.; a humidity of 95%) for 960 hours. The stored welded articles were visually observed, so as to determine occurrence of rusting thereon (in particular, so as to determine a ratio of rusting area relative to the surface area of the article). From the observation, rust inhibition performance of the lubricants was evaluated based on the following reference levels:

Superior: The ratio of rusting area less than 10%

Inferior: The ratio of rusting area not less than 10%

Results are shown in Table 4.

TABLE 7

| | Rust Inhibition Performance | |
|---|---|---|
| | Welded Articles Formed from Work Pieces 1 | Welded Articles Formed from Work Piece 2 |
| Modifier Oil Example 1 | Superior | Superior |
| Modifier Oil Example 2 | Superior | Superior |
| Modifier Oil Example 3 | Superior | Superior |
| Lubricant Control 1 | Inferior | Inferior |
| Lubricant Control 2 | Inferior | Inferior |
| Lubricant Control 3 | Inferior | Inferior |

TABLE 7-continued

| | Rust Inhibition Performance | |
|---|---|---|
| | Welded Articles Formed from Work Pieces 1 | Welded Articles Formed from Work Piece 2 |
| Lubricant Control 4 | Inferior | Inferior |
| Lubricant Control 5 | Inferior | Inferior |
| Lubricant Control 6 | Inferior | Inferior |

Table 7 demonstrates that all of the example modifier oils of Modifier Oil Examples 1-3 have superior rust inhibition performance for the welded articles.

To the contrary, all of the control lubricants of Lubricant Controls 1-6 have inferior rust inhibition performance for the welded articles. Presumably, such inferior rust inhibition performance results from melting of the additives due to welding heat. Further, in the welded articles having the lubricant of Lubricant Control 1 that contains a chlorine-based additive, the ratio of rusting area was substantially 100%. This means that the lubricant of Lubricant Control 1 has extremely inferior rust inhibition performance than the lubricants of remaining control lubricants (Lubricant Controls 2-6).

Next, in a sixth test, three example modifier oils (Modifier Oil Examples 1-3) and six control lubricants (Lubricant Controls 1-6) were prepared in the same manner as the fourth test. Compositions of Modifier Oil Examples 1-3 and the lubricants of Lubricant Controls 1-6 are shown in Tables 5a and 5b.

With regard to the example modifier oils of Modifier Oil Examples 1-3 and the control lubricants of Lubricant Controls 1-6, a self-removing performance evaluation test was performed. In order to perform the self-removing performance evaluation test, the work pieces were coated with the example modifier oils and the control lubricants. The work pieces coated with the example modifier oils and the control lubricants were used as test pieces for this test.

The test pieces for the self-removing performance evaluation test were prepared as follows.

Work Pieces

1. SPCC steel sheets

Dimension: 60 mm×80 mm×1.2 mm

2. Actual parts of a vehicle reclining seat that are formed from high tensile strength steel sheets having tensile strength of 590 N/mm$^2$ Thickness: 1.8 mm Application of the Lubricants The example modifier oils of Modifier Oil Examples 1-3 and the control lubricants of Lubricant Controls 1-6 were fed to the surfaces of the work pieces by a brush. The lubricant coated work pieces were left at a room temperature for 24 hours.

Further, an aqueous cleaning liquid for this test was formulated as follows.

Cleaning Agent

Commercially available surface treatment agent for steel (which can form an iron phosphate thin film on a steel surface during washing)

Concentration of Cleaning Agent

4% (Diluted by tap water)

The test pieces thus formed were washed in the cleaning liquid that is heated to 60° C. Washing operation was continued for 180 seconds by dipping while the cleaning liquid is stirred. After washing, the washed test pieces were took out from the cleaning liquid and visually observed, so as to determine surface wettability thereof (in particular, so as to determine a ratio of wetting area relative to the surface area of each test pieces). From the observation, self-removing performance of the lubricants was evaluated based on the following reference levels:

Superior: The ratio of wetting area not less than 80%

Inferior: The ratio of wetting area less than 80%

Results are shown in Table 8.

TABLE 8

| | Self-Removing Performance | |
|---|---|---|
| | Test Pieces formed from Work Pieces 1 | Test Pieces formed from Work Piece 2 |
| Modifier Oil Example 1 | Superior | Superior |
| Modifier Oil Example 2 | Superior | Superior |
| Modifier Oil Example 3 | Superior | Superior |
| Lubricant Control 1 | Superior | Superior |
| Lubricant Control 2 | Inferior | Inferior |
| Lubricant Control 3 | Inferior | Inferior |
| Lubricant Control 4 | Superior | Superior |
| Lubricant Control 5 | Superior | Superior |
| Lubricant Control 6 | Superior | Superior |

Table 8 demonstrates that all of the example modifier oils of Examples 1-3 have superior self-removing performance. This means that the modifier oils of Examples 1-3 can be easily removed from a steel surface.

To the contrary, the lubricants of Lubricant Controls 2 and 3 have inferior self-removing performance. That is, the lubricants of Lubricant Controls 2 and 3 cannot be easily removed from the steel surface.

As will be apparent from these results, the modifier oils of the present invention may have superior lubrication performance when they are used for processing the high tensile strength steel sheets. In addition, the modifier oils of the present invention may have superior rust inhibition performance for the steel sheets that are welded by the MAG welding method. Further, the modifier oils of the present invention may have superior self-removing performance for the steel sheets.

From these results, it is expected that superior lubricants may preferably be formulated by adding the modifier oil containing Ingredient A, Ingredient B and Ingredient C to the lubricant base composed of the paraffinic hydrocarbons having carbon numbers of 8-16.

On the basis of these results, in a seventh test, an example lubricant (Example 1) was prepared by utilizing the lubricant base and the modifier oil, which are listed below. Content of the modifier oil in the formulated example lubricant was 15 wt % of total weight of the lubricant. The example lubricant was formulated so as to have kinetic viscosity of 2.8 $mm^2/s$ at −20° C.

(1) The lubricant base

The paraffinic hydrocarbon of Lubricant Sample 2

Carbon number: 10-13

(2) The modifier oil

The modifier oil of Modifier Oil Example 3

Sulfur content: 1.0 wt % of total weight of the lubricant

Rust inhibitive agent content: 0.9 wt % of total weight of the lubricant oil

Calcium content: 0.1 wt % of total weight of the lubricant

With regard to the example lubricant of Example 1, a lubrication performance evaluation test was performed at different temperatures (room temperature and a subzero temperature of −20° C.). In order to perform the lubrication performance evaluation test, work pieces having the example lubricant were processed (press worked) at room temperature and the subzero temperature, so as to produce formed articles (test pieces). In addition, as controls, work pieces were processed without the example lubricant (i.e., processed by a dry processing), so as to produce formed articles (test pieces).

Preparation of the formed articles was carried out under following conditions.

Processing Machine

AIDA pressing machine having a punch and a die (Aida Engineering)

Processing speed: 40 spm

Shot number: 1000

Material of the punch: SKD11

Material of the die: SKD11

Work Pieces

High tensile strength steel sheets having tensile strength of 590 $N/mm^2$

Width: 90 mm

Thickness: 1.8 mm

Work Pieces for Controls

Steel sheets with rust inhibitive oils

After the processing (press working) of each of the work pieces having the lubricant of Example 1 was completed, with regard to each of the test pieces (formed articles), an amount of the lubricant remaining on the test piece (which amount will be referred to as "Am"), a width of the test piece and a shear surface length of the test piece were determined. As will be appreciated, the shear surface length corresponds to a smooth cut surface length. Further, with regard to each processing, a pressing load required for the processing is determined.

Results are shown in Table 9.

TABLE 9

| | Room Temperature | Subzero Temperature (−20° C.) | Dry Processing |
|---|---|---|---|
| Am ($mg/cm^2$) | 0.074 | 0.073 | 0.073 |
| Required Pressing Load (ton) | 53 | 52 | 54 |
| Test Piece Width (mm) | 66.5 | 66.5 | 66.5 |
| Test Piece Shear Surface Length (mm) | 0.57 | 0.59 | 0.56 |

As shown in Table 9, with regard to the amount of lubricant of remaining on the test piece (which amount will be referred to as "Am"), the test pieces produced at the subzero temperature has substantially the same value as the test pieces produced at room temperature and the test pieces processed by the dry processing (i.e., 0.073 to 0.074 $mg/cm^2$). Therefore, the test pieces produced at the subzero temperature can be treated in the same manner as the test pieces produced at room temperature, so as to remove or wash out the lubricant remaining thereon.

Further, with regard to the pressing load required for the processing, the work piece processed at the subzero temperature of (−20° C.) has the lowest value (52 ton). This means that the example lubricant may have excellent lubricity when it is used at the subzero temperature (−20° C.). Such excellent lubricity at the subzero temperature may lead to a long service life of the processing tool.

Further, with regard to the shear surface length (the smooth cut surface length) of the test piece, the work piece processed at the subzero temperature (−20° C.) has the largest value (0.059 mm). This means that the example lubricant may contribute to increase processing accuracy of the work piece (metallic material) when it is used at the subzero temperature (−20° C.).

In an eighth test, example lubricants (Examples 2-5) were prepared by utilizing the lubricant base (Lubricant Sample 2) and the modifier oil (Modifier Oil Example 3) that are used in the seventh test. In Examples 2-5, content of the modifier oil in the formulated example lubricant (which content will be referred to as "Co") was changed in a range of 2-20 wt % of total weight of the lubricant.

With regard to the example lubricants of Examples 2-5, a lubrication performance evaluation test was performed at different temperatures (room temperature and a subzero temperature of ±20° C.). In order to perform the lubrication performance evaluation test, work pieces having the example lubricant were processed (press worked) at room temperature and the subzero temperature, so as to produce formed articles (test pieces).

Preparation of the test pieces was carried out under the same condition as the seventh test.

After the processing (press working) of each of the work pieces was completed, with regard to each of the test pieces (formed articles), an amount of the lubricant remaining on the test piece (Am) was determined. In addition, a ratio of [the amount of the lubricant remaining on the test piece at room temperature (which amount will be referred to as "Am-R")] to [the content of the modifier oil in the formulated example lubricant (which content will be referred to as "Co")] (i.e., Am-R/Co) was calculated. Similarly, a ratio of [the amount of the lubricant remaining on the test piece at the subzero temperature (which amount will be referred to as "Am-S")] to [the content of the modifier oil in the formulated example lubricant (Co)] (i.e., Am-S/Co) was calculated. Also, a ratio of [the amount of the lubricant remaining on the test piece at the subzero temperature (Am-S)] to [the amount of the lubricant remaining on the test piece at room temperature (Am-R)] (i.e., Am-S/Am-R) was calculated.

Results are shown in Table 10.

TABLE 10

| | | Room Temperature | | Subzero Temperature (−20° C.) | | |
|---|---|---|---|---|---|---|
| | Co (wt %) | Am-R ($mg/cm^2$) | Am-R/Co | Am-S ($mg/cm^2$) | Am-S/Co | Am-S/Am-R |
| Example 2 | 2 | 0.0334 | 0.01670 | 0.0284 | 0.01420 | 85.0% |
| Example 3 | 10 | 0.0579 | 0.00579 | 0.0466 | 0.00466 | 80.4% |
| Example 4 | 15 | 0.0804 | 0.00536 | 0.0784 | 0.00522 | 97.5% |
| Example 5 | 20 | 0.1154 | 0.00577 | 0.0618 | 0.00309 | 53.6% |

As shown in Table 10, the test pieces having the lubricant of Example 4 (Co: 15 wt %) has an Am-S value (0.0784 $mg/cm^2$) that is closer to the value (0.073 $mg/cm^2$) in the test pieces produced the dry processing (Table 9). In addition, the test pieces having the lubricant of Example 4 has the highest Am-S/Am-R value (97.5%). Therefore, it is considered that the example lubricant of Example 4 may be more suitable for use in metal processing at the subzero temperature (−20° C.).

Further, the test pieces having the lubricant of Example 2 (Co: 2 wt %) has an extremely high Am-R/Co value (0.01670) and an extremely high Am-S/Co value (0.01420). Also, the test pieces having the lubricant of Example 5 (Co: 20 wt %) has an extremely low Am-S/Am-R (53.6%). Therefore, it is considered that upper and lower limits of the Co value are respectively about 2% and 20%.

Further, as will be derived from Table 10, an average Am-R/Co value of the test pieces having the lubricants of Examples 3-5 is 0.0056 $mg/cm^2$. Conversely, an average Am-S/Co value of the test pieces having the lubricants of Examples 3-5 is 0.0043 $mg/cm^2$. Therefore, it is considered that these lubricants are suitable for use in metal processing at the subzero temperature (−20° C.).

A representative embodiment of the present invention has been described in detail. This detailed description is merely intended to teach a person of skill in the art further details for practicing preferred aspects of the present invention and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present invention.

What is claimed is:

1. A lubricant for use in processing of a high tensile strength steel sheet, consisting of:

a lubricant base consisting essentially of hydrocarbons having a carbon number of 8-16 and a boiling point of 210° C. or less, and a modifier oil added to the lubricant base at a rate of 2-20 wt % of total weight of the lubricant, wherein the modifier oil contains (a) a sulfuric extreme pressure agent, (b) a rust inhibitive agent and (c) a calcium ingredient composed of highly-basic calcium sulfonates having base value of 300 mg KOH/g or more, wherein content of sulfur is 0.5-20 wt % of total weight of the modifier oil, wherein content of the rust inhibitive agent is 0.1-15 wt % of total weight of the modifier oil, wherein content of calcium is 0.1-15 wt % of total weight of the modifier oil, and wherein the lubricant has freezing point of not more than −40° C., kinetic viscosity of not greater than 12.5 $mm^2/s$ at −20° C., a flash point of 40° C. or more, and an ignition point of 240° C. or more, and wherein the rust inhibitive agent comprises at least one barium sulfonate, at least one oxidized wax compound, at least one calcium sulfonate, and at least one metallic soap of lanolin.

2. A method for processing a metallic material using a processing tool, comprising the steps of:

feeding a lubricant according to claim 1 between the metallic material and the processing tool, and processing the metallic material at a temperature of −5 to −35° C.

* * * * *